US006276861B1

(12) United States Patent
Tachikawa

(10) Patent No.: US 6,276,861 B1
(45) Date of Patent: Aug. 21, 2001

(54) WRITING INSTRUMENT

(75) Inventor: Toshikazu Tachikawa, Sakai (JP)

(73) Assignee: Tachikawa Kabushiki Kaisha, Osaku-fu (JP)

( * ) Notice: Subject to any disclaimer, the term of this patent is extended or adjusted under 35 U.S.C. 154(b) by 0 days.

(21) Appl. No.: 09/474,263

(22) Filed: Dec. 29, 1999

(51) Int. Cl.[7] ..... B43K 5/18
(52) U.S. Cl. ..... 401/240; 401/231; 401/224
(58) Field of Search ..... 401/223, 224, 401/222, 231, 240

(56) References Cited

U.S. PATENT DOCUMENTS 5,954,444 * 9/1999 Albright ..... 401/240

* cited by examiner

*Primary Examiner*—David J. Walczak
(74) *Attorney, Agent, or Firm*—Ronald E. Greigg; Edwin E. Greigg

(57) ABSTRACT

A writing instrument comprising a pen point receiver, a pen point and an ink introducing core member. The tip end portion of the pen point is formed to curve downwardly towards the tip end writing portion with respect to the base end portion of the pen point.

1 Claim, 6 Drawing Sheets

WRITING INSTRUMENT

BACKGROUND OF THE INVENTION

1. Field of the Invention

This invention relates to a writing instrument which can draw fine lines without causing a blur.

2. Prior Art

Writing instruments such as fountain pens make it possible to write with a writing portion by having a structure in which ink in an ink container installed in a penholder is percolated through a bunch of fibers in a pen point receiver which is inserted into a tip end opening portion of the penholder. The ink is supplied from a tip end of the bunch of fibers to the inner surface of the tip end portion of the pen point supported by the pen point receiver. The ink is then introduced to a writing end portion of the pen point through a split formed in the middle of the tip end portion of the pen point.

In such writing instruments structured as mentioned above, the pen point is conventionally formed to curve downwardly from a center of the pen point in its width directions to both edges thereof to make an arc. The pen point is formed to have a venthole at a predetermined length of interval from the writing end portion towards a base end portion of the pen point, and to have a straight split penetrating from the venthole to the center of the writing end portion.

However, according to the above-mentioned pen point, the side fragments of the end portion divided by the split curve with respect to the width directions but they are straight in its longitudinal directions to have a two-dimensional structure. A bend-resistance of the writing end portion against a strength of the pen stroke at the time of writing is inferior. When pressure is exerted on the pen point, both of the side fragments easily warp upwards with the venthole side as a fulcrum; therefore, the split is widened and there arises a problem that the letters and lines become thicker. Therefore, although the conventional pen point may be suitable to write sentences and the like subtly adjusting thickness of letters by changing the strength of the pen stroke, it is difficult to draw an illustration with innumerable fine pieces of hair, for example.

Further, since the writing end portion is easily warped upwards by a strong pen stroke, a gap is made between the writing end portion and the pen point receiver, and letters may blur because a supply of ink from the tip end portion of a bunch of fibers for supplying ink to the pen point becomes insufficient. Furthermore, as the elastic restoration force of the writing end portion is impeded by repeatedly working bend forces at the time of writing, there is a fear that the pen point cannot be used due to a distorted state of the tip end portion of the pen point and the pen point receiver having a gap between them.

Therefore, in order to maintain the elastic restoration force for a long period of time and to resist against such repeated load as a bend force acting on the pen point at a time of writing, it is required to make a thickness of the pen point bigger, in which case it becomes impossible to draw extra fine lines.

SUMMARY OF THE INVENTION

An object of the present invention is to provide a writing instrument having a pen point structure by which a lot of fine lines can be smoothly drawn without causing a blur, and by which distortion and deformation of the pen point are rarely caused due to a strong elastic restoration force.

To achieve the above object, the writing instrument according to this invention comprises a pen point receiver inserted into a tip end opening of a penholder in which an ink container is received. The writing instrument has a pen point having a split of a predetermined length from a writing end portion of the pen point. A base end portion of the pen point is inserted into the tip end opening of the penholder in a state that the pen point is overlapped on the upper surface of the pen point receiver. Then an ink introducing core member is provided in a center of the pen point receiver so that ink may percolate through a base end portion of the ink introducing core member. A tip end portion of the ink introducing core member is tightly contacted with the undersurface of a pen point tip end portion of the pen point. The writing device is characterized in that the tip end portion of the pen point is formed to curve downwardly towards the tip end writing portion with respect to the base end portion of the pen point.

In the above-mentioned writing instrument, it is preferable that the ink introducing core member comprises a bunch of fibers or an elastic porous material and the tip end portion of the core member is compressed elastically with a squeezing pressure between the undersurface of the pen point tip end portion and the upper surface of the tip end portion of the pen point receiver.

Further, it is also preferable that the pen point is made of a thin steel plate having wear resistance and elasticity.

According to the present invention, since the tip end portion of the pen point is formed to curve downwardly to have a three-dimension structure, it may obtain a great bending strength against a bending load loaded at the time of writing. Therefore, even if a writing load is great, the pen point maintains a strong elastic force within a range of an elastic limit. Therefore, it becomes possible to surely carry out a supply of ink by eliminating a blur of the letters or the like without interrupting the supply of ink to the pen point in a state that the undersurface of the tip end portion of the pen point is always in contact with the tip end portion of the ink introducing core member under pressure.

Further, it becomes possible to obtain a great elastic restoration force with respect to a writing load when the pen point is made thin, so that it may provide a pen point structure to draw extra fine lines continuously without causing a blur.

Furthermore, the tip end portion of the pen point is formed to curve downwardly, and a bunch of the fibers or the elastic porous material and tip end portion of the core member are compressed elastically with a squeezing pressure between the undersurface of the pen point tip end portion and the upper surface of the tip end portion of the pen point receiver. Even if the pen point is warped upwards and displaced due to a great writing pressure, the ink introducing core member is restored elastically according to its amount of displacement so as to maintain a state that the core member may always be in contact with the undersurface of the pen point under pressure. As a result, the ink, which is percolated through the ink introducing core member with capillarity, can always be introduced from the tip end portion of the core member to the tip end writing portion through the split of the pen point.

Advantages of this invention are as follows.

A writing instrument of this invention comprises a pen point receiver inserted into a tip end opening of a penholder in which an ink container is received. The pen point has a split of a predetermined length from a writing end portion of the pen point, and a base end portion of the pen is inserted into the tip end opening of the penholder in a state that the pen point is overlapped on the upper surface of the pen point receiver. An ink introducing core member is provided in a center of the pen point receiver so that an ink may percolate through a base end portion of the ink introducing core member. A tip end portion of the ink introducing core member is tightly in contact with the undersurface of a pen point tip end portion of the pen point. The writing device is characterized in that the tip end portion of the pen point is formed to curve downwardly towards the tip end writing portion with respect to the base end portion of the pen point. The tip end portion of the pen point may display a great bending strength against a bending load due to a writing pressure which is caused at the time of writing, and it becomes possible to disperse bending stress to the entire pen point which is curved downwardly without focusing bending stress on a portion of the pen point. The pen point may always repeatedly maintain a restoration force of elasticity within an elastic limit of the pen point. Therefore, it becomes possible to use the pen point for a long time without occurring strain and to control the tip end portion of the pen point so that the pen point does not separate from the pen point receiver under a great writing pressure. The tip end of the ink introducing core member is always in contact with the undersurface of the split of the pen point so that the pen point may smoothly and continuously carry a supply of ink from the ink introducing core member to the split.

Further, since the tip end portion of the pen point is formed to curve downwardly so as to generate a great elastic repulsive power against a writing load, it becomes possible to produce a thin pen point which has not been obtained before in a shape of the conventional pen point. Accordingly, the present invention provides a pen point which draws extra fine lines without a blur.

Furthermore, the tip end portion of the pen point is formed to curve downwardly, and a bunch of fibers or an elastic porous material and the tip end portion of the core member are compressed elastically with squeezing pressure between the undersurface of the pen point tip end portion and the upper surface of the tip end portion of the pen point receiver. Even if the pen point is warped upwards and displaced due to a great writing pressure, the ink introducing core member is restored elastically according to an amount of displacement so as to maintain a state that the core member may always be in contact with the undersurface of the pen point under pressure. Therefore, the ink, which is percolated through the ink introducing core member with capillarity, can always be introduced from the tip end portion of the core member to the tip end writing portion through the split of the pen point. As a result, it becomes possible to carry out a continuous stable supply of ink so as to surely eliminate occurrence of a blur even if fine lines are drawn.

Other advantages of this invention will be apparent from the description of the embodiments with reference to the drawings.

BRIEF DESCRIPTION OF THE DRAWINGS

The drawings show an embodiment of a writing instrument according to this invention in which.

DETAILED DESCRIPTION

Figure 1:
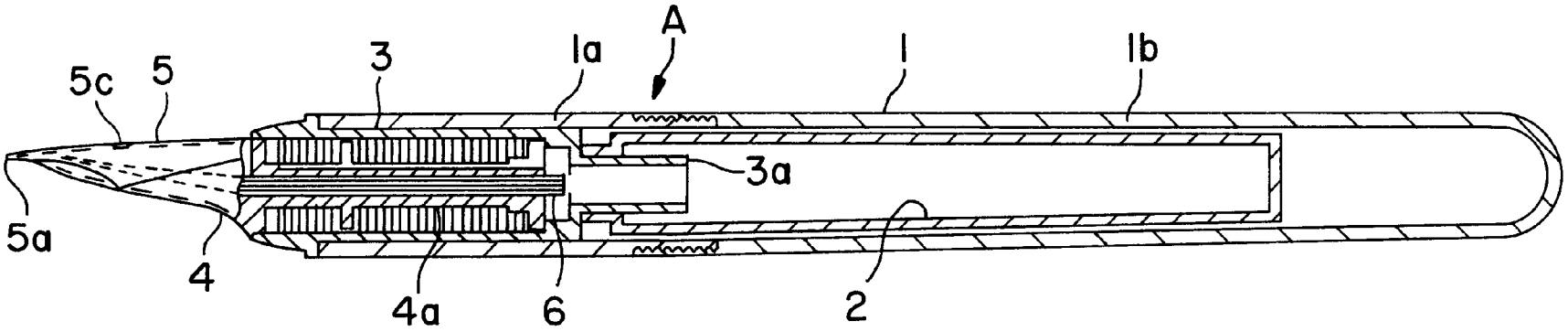
FIG. 1 is a cross sectional view of the writing instrument.

Embodiments of the present invention will be described with reference to the drawings. In FIG. 1, a writing instrument A comprises a penholder 1 having a predetermined length, which receives therein a replaceable ink container 2. A pen point receiver 4 is inserted into a tip end opening portion of the penholder 1 via a cylindrical holder 3. A pen point 5 is supported on the upper surface of the pen point receiver 4 and is inserted with its base portion between the undersurface of the upper peripheral portion of the tip end portion of the cylindrical holder 3 and the upper surface of the pen point receiver 4 in a squeezed state. An ink introducing core member 6 is made of a bunch of fibers such as felt and the like, and is arranged in a center portion of the pen point receiver 4 in a state that a base portion of the core member is directed to the ink container 2 and its tip end portion is in contact with a center portion of the tip end portion of the pen point 5. As the ink introducing core member 6, it may be formed by using an elastic porous material such as sponge and porous resin which provides a continuous porous structure with good capillarity.

Figure 2:
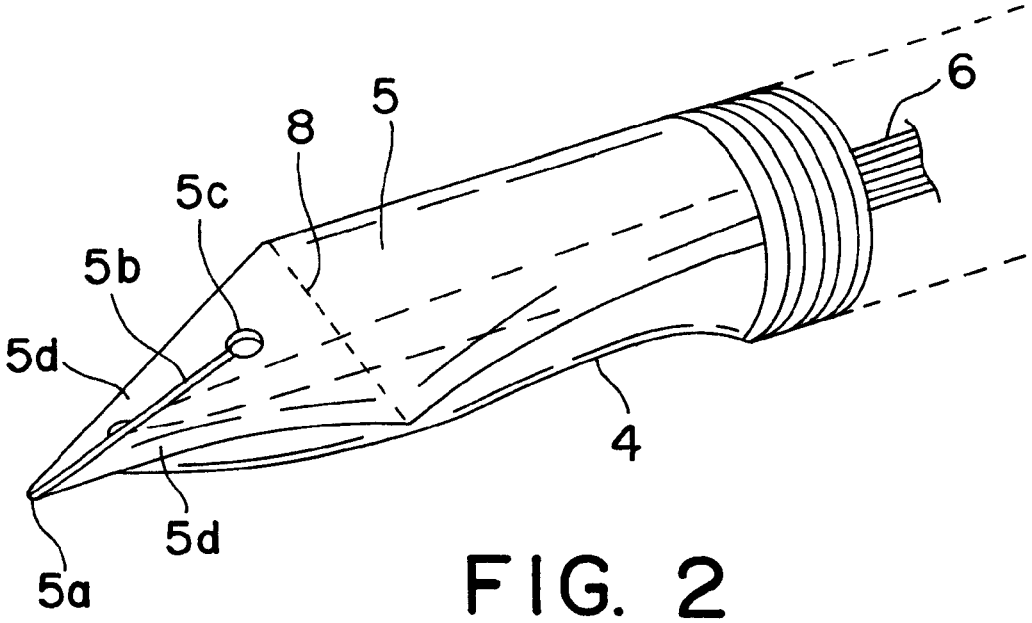
FIG. 2 is a perspective view of a pen point.
Figure 3:
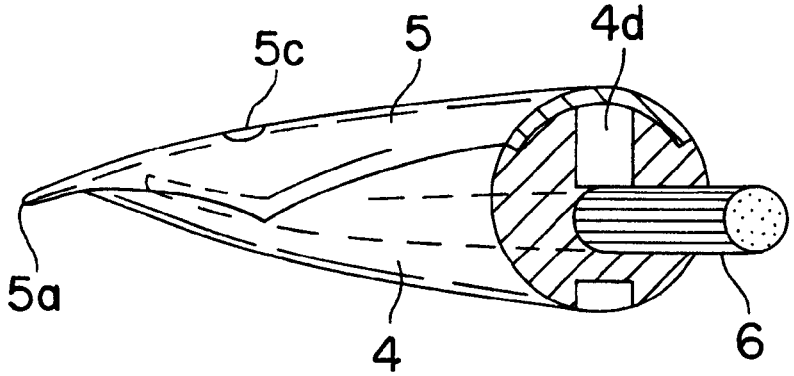
FIG. 3 is a perspective view looking from a rear view of the pen point.
Figure 4:
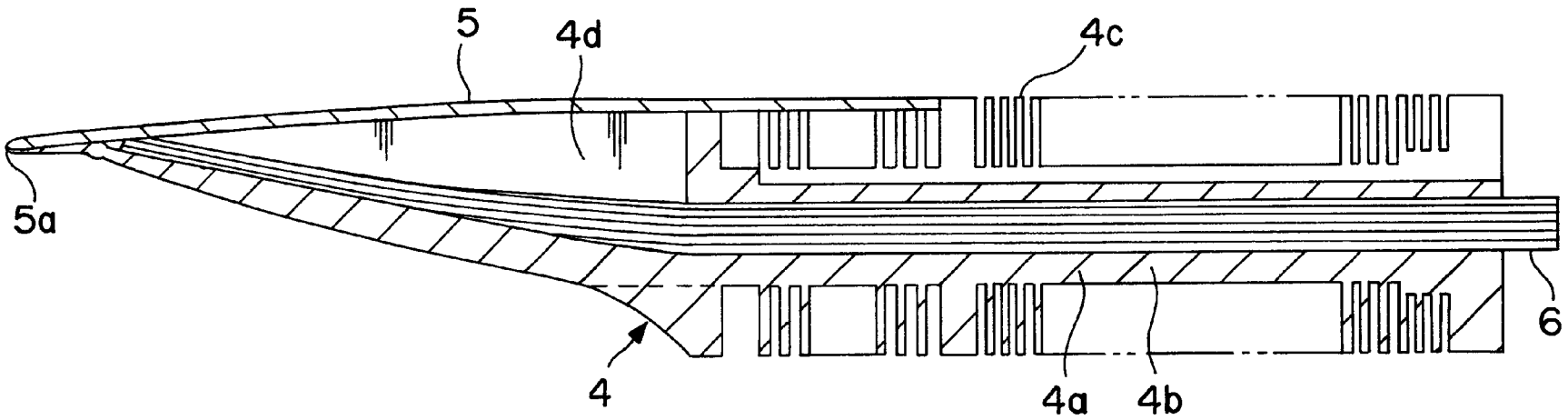
FIG. 4 is a sectional side view of a pen point receiver supporting the pen point.

The pen point 5 is made of a thin steel plate having superior wear resistance, corrosion resistance and elasticity, and the pen point is formed to curve downwardly from a center of the pen point in its width directions towards both edges thereof to make an arc, as is well known. The tip end portion of the pen point is formed to have a shape of a triangle in plan view that is gradually narrower towards its tip end so as to form a writing portion 5*a* of small width at its tip end. Further, a predetermined length of a split 5*b* is formed from the writing portion 5*a* towards a base portion of the pen point and a venthole 5*c* is opened with a base portion of the split 5*b,* so that both sides of the tip end portion of the pen point 5 may be divided into two pieces to make right and left side fragments. In the pen point 5 as formed above, as shown in FIGS. 2 to 4, the pen point forms a structure so that the tip end portion from a part of the venthole 5*c* which is a starting point, as shown by broken lines 8 in FIG. 2, to the writing portion 5*a* is curved downwardly towards the writing portion 5*a* with respect to the base portion of the pen point.

Therefore, both the right and left side fragments 5*d,* which form the tip end portion of the pen point 5, are thus curved downwardly towards the outside ends from the split 5*b* to form an arc. Also with respect to its longitudinal directions, the side fragments of the pen point are curved downwardly from the venthole 5*c* towards the writing portion 5*a* to form an arc so as to make a three-dimensional structure.

The pen point 5 is formed by punching a thin steel plate having a width of about 0.15~0.3 mm to form a pen point main body of the pen point 5 which is unfolded. Thereafter, a pressing process is carried out by bending, by means of a press machine. The pen point main body forms an arc from its center portion to both side edges, and then gently curving the main body downwardly from its center portion in the longitudinal directions thereof towards its tip end portion with a choking process and further the split 5*b* of a predetermined length from the writing portion 5*a* towards the base portion thereof is formed together with the venthole 5*c*. As an extent of curvature of the pen point by the choking process, it is, for example, preferable that the pen point is curved from its center portion to its tip end with the radius of curvature of about 200 mm and also it is preferable that an angle, which is formed with an extended horizontal line of the base portion and a straight line in the direction of its curving surfaces that crosses the extended horizontal line, may be about 4 to 5 degrees, but they are not limited particularly.

The pen point receiver 4 supporting the pen point 5 has a rear part from its center portion to its base portion. The rear part is formed by a small diameter cylindrical portion 4*a* having a guide opening 4*b* into which the ink introducing core member 6 is inserted. A comb groove portion 4*c* comprising a number of disc scales which are projecting on the periphery of the small diameter cylindrical portion 4*a* leaves a small distance between the disc scales in the longitudinal directions. On the other hand, a front part of the pen point receiver is formed to be narrow towards its tip end and its upper periphery is formed to be a shape which may contact the undersurface of the pen point 5 with the upper periphery of the pen point receiver. Further, a guide groove 4*d*, which has a width equal to a diameter of the ink introducing core member 6, is formed to have a depth reaching a center portion of the pen point receiver from a center portion of the upper periphery. The lower end base portion (rear end) of the guide groove 4*d* communicates with the guide opening 4*b* and the groove bottom of the guide groove 4*d* is inclined gently and upwardly towards the tip end (front end) so as to place the inclined upper end thereof to face the undersurface of the tip end portion of the pen point 5.

Figure 5:
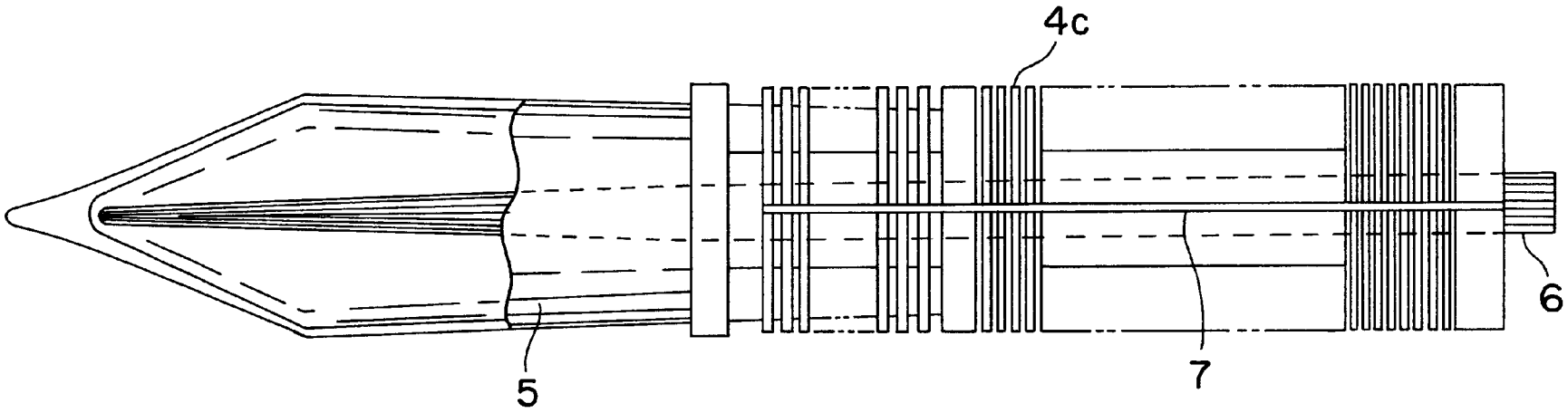
FIG. 5 is a plan view of the pen point receiver partially broken away.

Further, the ink introducing-core member 6, which is formed by a bunch of fibers to appear like a thin string having a circle in section, is inserted through the guide opening 4*b* to reach the tip end of the guide groove 4*d*. The base end portion of the core member is made to project rearwardly from the guide opening 4*b* and its tip end is compressed to be flat by pressing between the tip end upper surface of the pen point receiver 4 and the tip end undersurface of the pen point 5, so that the core member is elastically contacted under pressure with the undersurface of the pen point beneath the split 5*b* and is freely received in the guide groove except in the front end portion thereof. As shown in FIG. 5, there is provided a thin groove 7 for ventilation on the peripheral portion of the comb groove portion 4*c* of the pen point receiver 4 to communicate its base end with the guide groove 4*d*. The pen point receiver 4 is inserted into the cylindrical holder 3 with its comb groove portion 4*c* in a state that the pen point 5 is overlapped on the upper surface of the tip end portion of the pen point receiver. The base end portion of the pen point 5 is squeezed and fixed by the upper peripheral surface of the tip end portion of the comb groove portion 4*c* and the inner peripheral surface of the upper peripheral portion of the tip end portion of the cylindrical holder 3. The cylindrical holder 3 is inserted into the tip end opening portion of the penholder 1, and a small diameter cylindrical portion 3*a* is formed integrally with the holder 3 at a center of the base end thereof to project rearwardly. The tip end opening of the ink container 2 as a spare is connected to the small diameter cylindrical portion 3*a* so as to supply ink of the ink container 2 to the base end portion of the ink introducing core member 6 via the small diameter cylindrical portion 3*a*. The cylindrical portion faces the core member, so that ink may be percolated through the ink introducing core member 6 with capillarity to reach its tip end. The penholder 1 receiving the ink container 2 is divided into two pieces as a forward half portion 1*a* and a rear half portion 1*b* which are connected separably by means of a screw.

Figure 6:
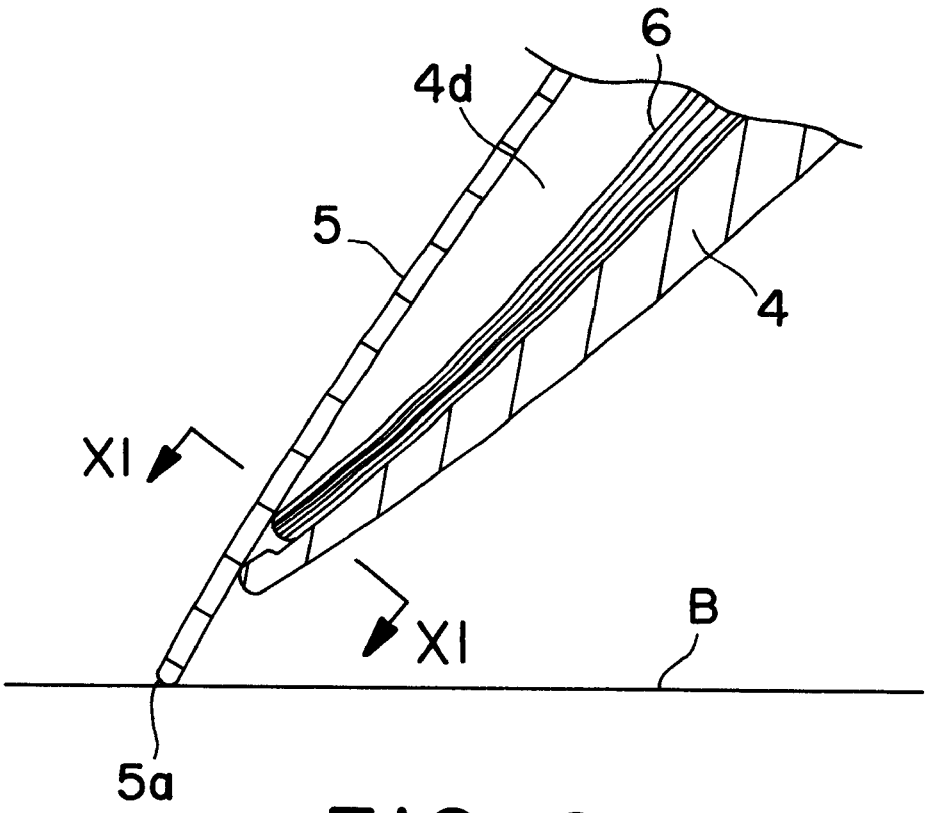
FIG. 6 is a sectional side view of a tip end portion of the pen point in a state of use.

By using the writing instrument A as mentioned above, the pen point 5 is placed on a paper B, as shown in FIG. 6, and writing is carried out with its tip end writing portion 5*a*. Then, the tip end writing portion 5*a* receives a bending load and is warped in an upward direction. The right and left side fragments 5*d* forming the tip end of the pen point 5 are curved downwardly from the split 5*b* towards its outer side to form an arc and also curved downwardly with respect to its longitudinal directions from the venthole 5*c* to the tip end writing 5*a* to form an arc so as to make a three-dimensional structure. The side fragments display a great strength against bending stress in a direction of warp and it is possible to prevent the bending stress to focus on the base portions of the right and left side fragments 5*d*. In order to disperse the bending stress to the entire right and left side fragments 5*d*, the restoration force of these fragments may always be maintained repeatedly within an elastic limit thereof. Further, the restoration force may control separation of the pen point 5 from the pen point receiver 4 even if a great writing force is acting on the pen point, and contact the tip end portion of the ink introducing core member 6 with the undersurface of the pen point 5 beneath the split 5*b* so as to continue the supply of ink from the ink introducing core member 6 to the split 5*b*.

Figure 7:
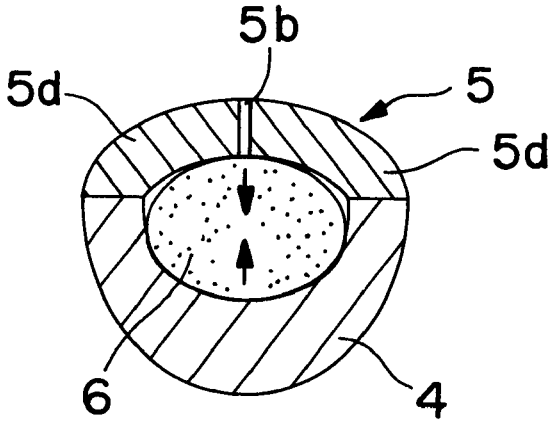
FIG. 7 is an enlarged sectional front view taken along lines X1—X1 of FIG. 6.
Figure 8:
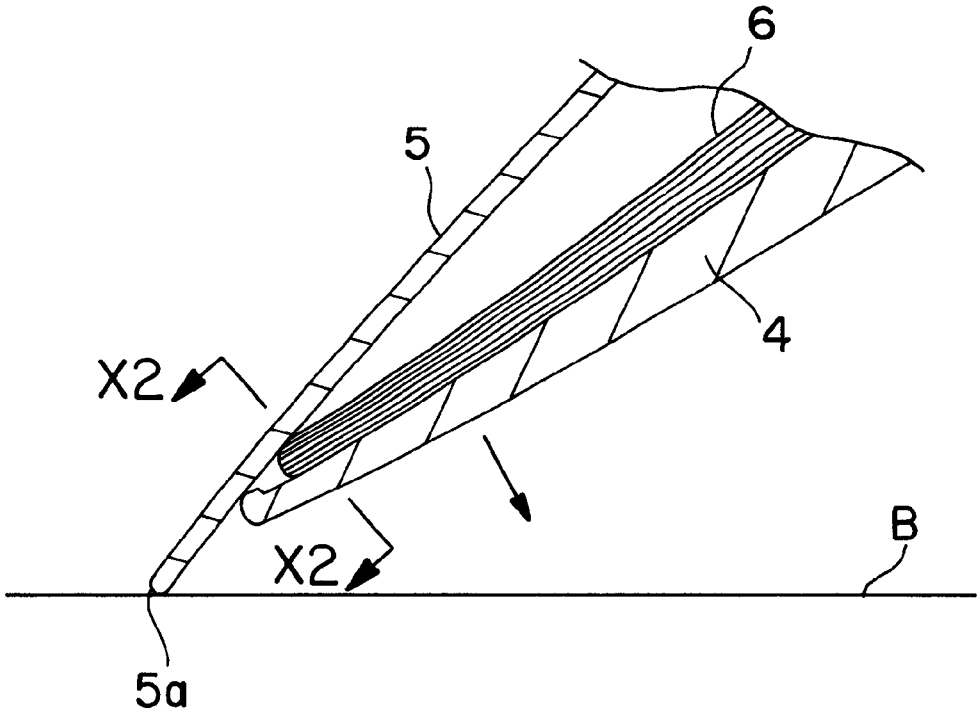
FIG. 8 is a sectional side view of the tip end portion of the pen point in a state of drawing with a great writing pressure.
Figure 9:
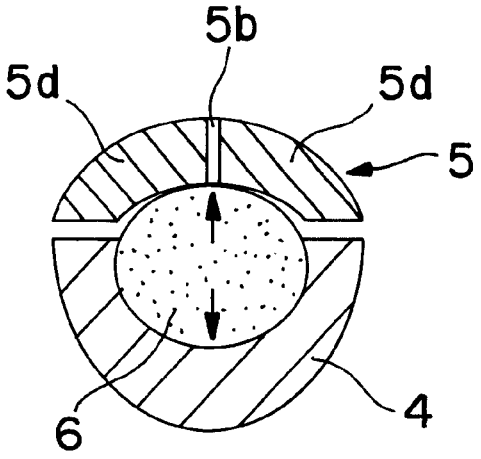
FIG. 9 is an enlarged sectional front view taken along lines XII—XII of FIG. 8.

Further, even if warp occurs with the pen point 5 due to a strong bending load as shown in FIG. 7, the ink introducing core member 6 is squeezed under pressure between the undersurface of the tip end portion of the pen point 5 and the upper surface of the pen point receiver 4. The ink introducing core member 6 is made of a bunch of fibers which have an elastic restoration force. The ink introducing core member 6 may be extended elastically according to an amount of displacement of warp, to maintain a state that the tip end portion of the core member is always in contact with the undersurface of the tip end portion of the pen point 5 under pressure so as to continue the flow of ink smoothly with respect to the pen point 5 and to carry out writing of fine lines without causing a blur. Next, examples of this invention will be described.

EXAMPLE 1

To form a pen point, a steel plate having a thickness of 0.27 mm is punched by means of a press machine and then the steel plate is bent to have a bending radius of 3.5 mm in a direction of width, and it is curved downwardly with a bending radius of 200 mm so as to have an angle of 4.5° with respect to a center line of its tip end portion. Further, a split of a predetermined length is formed with the tip end writing portion of the pen point from its center portion to its base end and a venthole is formed with the base end portion of the split. By using the writing instrument having the pen point, it becomes possible to carry out a continuous drawing with a fine line having a width of 0.25 mm and a length of 1500 m. Where writing pressure increases up to 150 g, the width of the line becomes 0.36 mm and when the writing pressure returns to 50 g, the width of the line also returns to 0.25 mm.

EXAMPLE 2

A steel plate having a thickness of 0.18 mm is processed in the same manner as the above example 1 and then the plate has obtained a pen point with a writing portion having a width of 0.18 mm. By using the writing instrument having the pen point, a continuous drawing is carried out on a test paper under the same conditions as the above example 1. It becomes possible to draw continuously a fine line having a width of 0.2 mm. Where writing pressure increases up to 150 g, the width of the line becomes 0.25 mm and when the writing pressure returns to 50 g, the width of the line also returns to 0.2 mm.

The foregoing relates to preferred exemplary embodiments of the invention, it being understood that other variants and embodiments thereof are possible within the spirit and scope of the invention, the latter being defined by the appended claims.

What is claimed is:

1. A writing instrument comprising:

a penholder in which an ink container is received, a pen point of thin steel plate having a predetermined length of a split formed from a writing end portion of the pen point to a base portion thereof, a venthole opened in the base portion of the split; said pen point being curved downwardly from the venthole to the writing portion and also curved in directions of its width to form an arc, and a base end portion of the pen point being inserted into a tip end opening of the pen holder, an ink introducing core member for introducing ink from the ink container to the pen point, a pen point receiver having a front part formed in a shape which makes a contact between an undersurface of a periphery of the pen point and an upper periphery of the pen point receiver from a base portion of the pen point to near the writing portion thereof; said pen point receiver being provided with a guide groove having a bottom which is gently inclined upwards to a front part of the pen point receiver so as to elastically compress a front end of the ink introducing core member between an undersurface of the writing portion of the pen point and an upper surface of the pen point receiver while receiving the ink introducing core member freely in the guide groove except in the front end portion thereof.

* * * * *